US005887652A

United States Patent [19]

Beck et al.

[11] Patent Number: 5,887,652

[45] Date of Patent: Mar. 30, 1999

[54] METHOD AND APPARATUS FOR BOTTOM-HOLE TESTING IN OPEN-HOLE WELLS

[75] Inventors: Harold K. Beck, Copper Canyon, Tex.; Roger L. Schultz, Stillwater, Okla.

[73] Assignee: Halliburton Energy Services, Inc., Dallas, Tex.

[21] Appl. No.: 906,188

[22] Filed: Aug. 4, 1997

[51] Int. Cl.[6] ..... E21B 49/00

[52] U.S. Cl. ..... 166/264; 166/250.07

[58] Field of Search ..... 166/264, 250.07, 166/50; 175/40

[56] References Cited

U.S. PATENT DOCUMENTS

| | | | |
|---|---|---|---|
| 2,222,829 | 11/1940 | Humason et al. | 166/1 |
| 2,819,038 | 1/1958 | Eckel | 255/1.4 |
| 2,978,046 | 4/1961 | True | 175/233 |
| 3,103,811 | 9/1963 | Ayres et al. | 73/152 |
| 3,107,729 | 10/1963 | Barry et al. | 166/66 |
| 3,111,169 | 11/1963 | Hyde | 166/145 |
| 3,327,781 | 6/1967 | Nutter | 166/3 |
| 3,441,095 | 4/1969 | Youmans | 175/59 |
| 3,448,611 | 6/1969 | Lebourg | 73/151 |
| 3,577,781 | 5/1971 | Whitten et al. | 73/152 |
| 3,611,799 | 10/1971 | Davis | 73/155 |
| 3,780,575 | 12/1973 | Urbanosky | 73/152 |
| 3,850,240 | 11/1974 | Conover | 166/162 |
| 3,864,970 | 2/1975 | Bell | 73/155 |
| 3,876,003 | 4/1975 | Kisling, III | 166/250 |
| 4,043,407 | 8/1977 | Wilkins | 175/50 |
| 4,142,594 | 3/1979 | Thompson et al. | 175/59 |
| 4,230,180 | 10/1980 | Patton et al. | 166/185 |
| 4,287,946 | 9/1981 | Brieger | 166/100 |
| 4,339,948 | 7/1982 | Hallmark | 73/155 |
| 4,370,886 | 2/1983 | Smith, Jr. et al. | 73/153 |
| 4,392,376 | 7/1983 | Lagus et al. | 73/155 |
| 4,535,843 | 8/1985 | Jageler | 166/250 |
| 4,573,532 | 3/1986 | Blake | 166/264 |
| 4,583,595 | 4/1986 | Czernichow et al. | 166/264 |
| 4,635,717 | 1/1987 | Jageler | 166/250 |
| 4,745,802 | 5/1988 | Purfurst | 73/155 |
| 4,787,447 | 11/1988 | Christensen | 166/169 |
| 4,856,585 | 8/1989 | White et al. | 166/250 |
| 4,860,580 | 8/1989 | DeRocher | 73/155 |
| 4,903,765 | 2/1990 | Zunkel | 166/162 |
| 4,936,139 | 6/1990 | Zimmerman et al. | 73/155 |
| 5,058,674 | 10/1991 | Schultz et al. | 166/264 |
| 5,105,881 | 4/1992 | Thoms et al. | 166/250 |
| 5,240,072 | 8/1993 | Schultz et al. | 166/169 |
| 5,287,741 | 2/1994 | Schultz et al. | 73/155 |
| 5,329,811 | 7/1994 | Schultz et al. | 166/264 X |
| 5,353,875 | 10/1994 | Schultz et al. | 166/297 |
| 5,368,100 | 11/1994 | Lewandowski et al. | 166/264 |
| 5,540,280 | 7/1996 | Schultz et al. | 166/250.07 |
| 5,555,945 | 9/1996 | Schultz et al. | 166/250.07 X |
| 5,609,205 | 3/1997 | Massie et al. | 166/264 X |
| 5,687,791 | 11/1997 | Beck et al. | 166/264 X |

*Primary Examiner*—Frank Tsay
*Attorney, Agent, or Firm*—Paul I. Herman; Neal R. Kennedy

[57] ABSTRACT

Apparatus and method for testing an open-hole well and obtaining a fluid sample therefrom. The apparatus comprises a compression packer on a drill pipe. Disposed in the drill pipe is a housing, defining a surge chamber therein, and a closure valve in communication with the surge chamber. A fluid sampler is in communication with the surge chamber. In operation, the packer is placed in a set position by setting down weight. The closure valve is pressure actuated so that fluid is flowed from a formation or zone of interest into the surge chamber and then into the sampler. By opening a housing valve at an upper end of the surge chamber, formation fluid may be forced back into the formation or zone of interest by a bull-heading operation. In a preferred embodiment, the packer and drill pipe are disconnectable from the remainder of the apparatus, and the packer is drillable.

31 Claims, 1 Drawing Sheet

METHOD AND APPARATUS FOR BOTTOM-HOLE TESTING IN OPEN-HOLE WELLS

BACKGROUND OF THE INVENTION

1. Field of the Invention

This invention relates to testing of oil and gas wells, and more particularly, to methods and apparatus for obtaining a fluid sample after flowing fluid into a surge chamber to obtain good drawdown of pressure in the well.

2. Description of the Prior Art

During the testing and completion of oil and gas wells, it is of ten necessary to test or evaluate the production capabilities of the well. This is typically done by isolating a subsurface formation or a portion of a zone of interest which is to be tested and subsequently flowing a sample of well fluid either into a surge chamber or up through a tubing string to the surface. Various data, such as pressure and temperature of the producing well fluids, may be monitored downhole to evaluate the long-term production characteristics of the formation.

One very commonly used well testing procedure is to first cement a casing into the borehole and then to perform the testing adjacent zones of interest. Subsequently, the well is flow tested through perforations in the casing. Such flow tests are commonly performed with a drill stem test string which is a string of tubing located within the casing. The drill stem test string carries packers, tester valves, circulating valves and the like to control the flow of fluids through the drill stem test string.

Although drill stem testing of cased wells provides very good test data, it has the disadvantage that the well must first be cased before the test can be conducted. Also, better reservoir data can be obtained immediately after the well is drilled prior to casing the well and before the formation has been severely damaged by drilling fluids and the like.

For these reasons alone, it is often desirable to evaluate the potential production capability of a well without incurring the cost and delay of casing the well. This has led to a number of attempts at developing a successful open-hole test which can be conducted in an uncased borehole.

One approach which has been used for open-hole testing is the use of a weight-set, open-hole compression packer on a drill stem test string. To operate a weight-set, open-hole compression packer, a solid surface must be provided against which the weight can be set. Historically, this is accomplished with a perforated anchor which sets down on the bottom. Another prior art procedure for open-hole testing is shown in U.S. Pat. No. 4,246,964 to Brandell, assigned to the assignee of the present invention. The Brandell patent is representative of the system marketed by the assignee of the present invention as the Halliburton Hydroflate System. The Hydroflate System utilizes a pair of spaced inflatable packers which are inflated by a downhole pump. With either of these devices, both of which have advantages and disadvantages, well fluids can then flow up the pipe string which supports the packers in the well.

Another approach to open-hole testing is through the use of pad-type wireline testers which simply press a small resilient pad against the side wall of the borehole and pick up samples through an orifice in the pad. An example of such a pad-type tester is shown in U.S. Pat. No. 3,577,781 to LeBourg. The primary disadvantage of pad-type testers is that they often take a very small unidirectional sample which is often not truly representative of the formation because it is "dirty" fluid which provides very little data on the production characteristics of the formation. It is also sometimes difficult to seal the pad. When the pad does seal, it is subject to differential sticking and sometimes the tool may be damaged when it is removed.

Another shortcoming of wireline formation testers which use a pad is that the pad is relatively small. If the permeability of the formation is high, hydrostatic pressure can be transmitted through the formation between the outside of the pad and the center of the pad where the pressure measurement is being made, in a very short period of time. This will result in major hydrostatic pressures soon after attempting to measure formation pressure. This may limit the effectiveness of wireline formation testers in some conditions.

The methods and apparatus of the present invention solve these problems by providing for flowing formation fluid into a surge chamber which is placed in communication with the formation or zone of interest by a pressure-actuated valve. This prevents the capturing of "dirty" fluid which initially comes out of the formation or zone of interest, while allowing capturing of a sample of the cleaner, more representative fluid flowing behind the dirty fluid.

Another approach which has been proposed in various forms is to provide an outer tubing string with a packer which can be set in a borehole, and in combination with a wireline-run surge chamber which is run into engagement with the outer string so as to take a sample from below the packer. One example of such a system is shown in U.S. Pat. No. 3,111,169 to Hyde, and assigned to the assignee of the present invention. Other examples of such devices are seen in U.S. Pat. No. 2,497,185 to Reistle, Jr.; U.S. Pat. No. 3,107,729 to Barry, et al.; U.S. Pat. No. 3,327,781 to Nutter; U.S. Pat. No. 3,850,240 to Conover; and U.S. Pat. No. 3,441,095 to Youmans. A disadvantage, obviously, is the extra time necessary to run-in and position the surge chamber.

A number of improvements in open-hole testing systems of the type generally proposed in U.S. Pat. No. 3,111,169 to Hyde are shown in U.S. Pat. No. 5,540,280 to Schultz et al., assigned to the assignee of the present invention. In a first aspect of the invention of U.S. Pat. No. 5,540,280, a system is provided including an outer tubing string having an inflatable packer, and a communication passage disposed through the tubing string below the packer, an inflation passage communicated with the inflatable element of the packer, and an inflation valve controlling flow of inflation fluid through the inflation passage. The inflation valve is constructed so that the opening and closing of the inflation valve is controlled by a surface manipulation of the outer tubing string. Thus, the inflatable packer can be set in the well simply by manipulation of the outer tubing string and applying fluid pressure to the tubing string without running an inner well tool into the tubing string. After the packer has been set, an inner well tool, such as a surge chamber, may be run into and engaged with the outer tubing string to place the inner well tool in communication with a subsurface formation through the communication passage. There is also an embodiment with a straddle packer having upper and lower packer elements which are engaged on opposite sides of the formation.

In another aspect of this prior invention, the well fluid samples are collected by running an inner tubing string, preferably an inner coiled tubing string, into the previously described outer tubing string. The coiled tubing string is engaged with the outer tubing string, and the bore of the coiled tubing string is communicated with a subsurface formation through the circulation passage defined in the outer tubing string. Then well fluid from the subsurface is flowed through the communication passage and up the coiled tubing string. Such a coiled tubing string may include various valves for control of fluid flow therethrough. This prior invention does not include the use of a surge chamber or sampler downhole to obtain the fluid sample.

In the present invention, a closure valve is utilized in the apparatus to open the surge chamber. The valve is actuated by pressure. A sampler in communication with the surge chamber is used to obtain a sample, and electronic pressure and/or temperature recording instruments may also be used to record fluid characteristics.

SUMMARY OF THE INVENTION

The purpose of the method and apparatus of the present invention is to obtain a fluid sample of clean, representative fluid from a well formation or zone of interest. This is accomplished by flowing sufficient fluid into a surge chamber carried in the tool so that "dirty" fluid is initially flowed out of the formation or zone of interest, after which clean fluid may be captured in a sampler.

The present invention includes a method of testing a well. The first step in the method comprises running a tool into the well. The tool comprises a housing defining a surge chamber therein, a normally closed closure valve in communication with a lower end of the surge chamber, a packer connected to the housing and having a packer element engagable with an inner surface of the well, and a sampler in communication with the housing. The method further comprises the steps of setting the packer such that the packer is in sealing engagement with the inner surface of the well and adjacent to a formation or zone of interest in the well, applying pressure in the tool for actuating the closure valve to place the surge chamber in communication with a well portion below the packer, initiating fluid flow from the zone through the closure valve into the surge chamber, and after flowing some fluid, capturing a sample in the sampler.

In the preferred embodiment, the step of initiating fluid flow comprises flowing dirty fluid from the zone for a sufficient time so that substantially cleaner fluid is flowed into the surge chamber when capturing a sample of fluid in the sampler.

The packer used in the method of the present invention is preferably a compression packer, and the step of setting the packer comprises setting down weight on the apparatus to place the packer element into sealing engagement with the inner surface of the well.

Additionally, the tool may further comprise a normally closed housing valve in communication with an upper end of the surge chamber, and the method may then comprise the steps of applying pressure in the tool for actuating the housing valve to an open position, and applying pressure to the tool through the open housing valve, surge chamber and closure valve to force formation fluid back into the formation or zone of interest. This operation is called "bull-heading."

In the event that the tool becomes stuck in the well, such as might occur when the formation or a portion of the well collapses around the packer, the method may further comprise the steps of releasing the housing, housing valve, closure valve and sampler from the packer, and then removing the housing, housing valve, closure valve and sampler from the well. After this, a step of drilling the packer out of the well may be carried out.

The apparatus of the present invention for use in testing an uncased well and obtaining a fluid sample from a subsurface formation or zone of interest in the well comprises a drill pipe defining an opening therein, a compression packer disposed on the drill pipe above the opening and adapted for sealingly engaging an inner portion of the well adjacent to the zone when the packer is in a set position, a housing disposed in the drill pipe wherein the housing defines a surge chamber therein, a closure valve disposed in the drill pipe and which is in communication with an end of the surge chamber, and a sampler disposed in the drill pipe and also in communication with the surge chamber. The closure valve is preferably a pressure-actuated valve which is normally closed and may be actuated to place the surge chamber in communication with the opening in the drill pipe. This allows fluid flow from the formation or zone into the surge chamber after which a fluid sample may be captured in the sampler.

The apparatus preferably further comprises a housing valve disposed in the drill pipe in communication with an opposite end of the surge chamber from the closure valve. The housing valve is normally closed and is pressure actuated.

The sampler may be opened to take a fluid sample after a predetermined time delay. This time delay is preferably sufficient for the packer to be set, the closure valve to be opened and for fluid to flow into the surge chamber. The sampler is preferably pressure actuated.

The housing, closure valve and sampler are detachable from the drill pipe, and the packer is preferably drillable.

The present invention may be characterized as including also includes a method of testing a previously non-produced segment of an uncased wellbore. The initial step is to run a tool into the uncased wellbore, wherein the tool comprises a housing defining a surge chamber therein and a packer connected to the housing. The packer is adapted for sealingly engaging an inner surface of the uncased wellbore. The method further comprises the steps of setting the packer into sealing engagement with the inner surface of the uncased wellbore adjacent to the previously non-produced segment, placing the surge chamber in communication with the previously non-produced segment, flowing fluid from the previously non-produced segment into the surge chamber, and capturing a sample of fluid from the previously non-produced segment. The step of capturing a sample of fluid preferably occurs after a predetermined period of time after initially flowing the fluid. That is, the method preferably comprises flowing dirty fluid from the previously non-produced segment for a sufficient time so that the substantially cleaner fluid is flowed into the surge chamber prior to sampling.

The invention further includes a method of testing a well incorporating "bull-heading." The method initially comprises running a tool into the well wherein the tool comprises a packer adapted for sealingly engaging an inner surface of the well and a sampler in communication with the housing. The method further comprises the steps of setting the packer such that the packer is sealingly engaged with the inner surface of the well and adjacent to a zone of interest in the well, initiating fluid flow from the zone, capturing a sample of fluid in the sampler, and after sampling, applying pressure through the tool to force formation fluid back into the zone of interest.

The tool in this method may further comprise a housing defining a surge chamber therein and a normally closed closure valve in communication with a lower end of the surge chamber. In this configuration, the step of initiating fluid flow from the zone comprises actuating the closure valve to an open position, thereby placing the surge chamber in communication with a well portion below the packer. The fluid is flowed through the closure valve into the surge chamber.

Also in this bull-heading method, the tool may further comprise a normally closed housing valve in communication with an upper end of the surge chamber, and the method may also include the step of actuating the housing valve to an open position prior to the step of applying pressure through the tool. The pressure is applied through the open housing valve, surge chamber and open closure valve.

Numerous objects and advantages of the invention will become apparent as the following detailed description of the preferred embodiment is read in conjunction with the drawings which illustrate such embodiment.

DESCRIPTION OF THE PREFERRED EMBODIMENT

Figure 1:
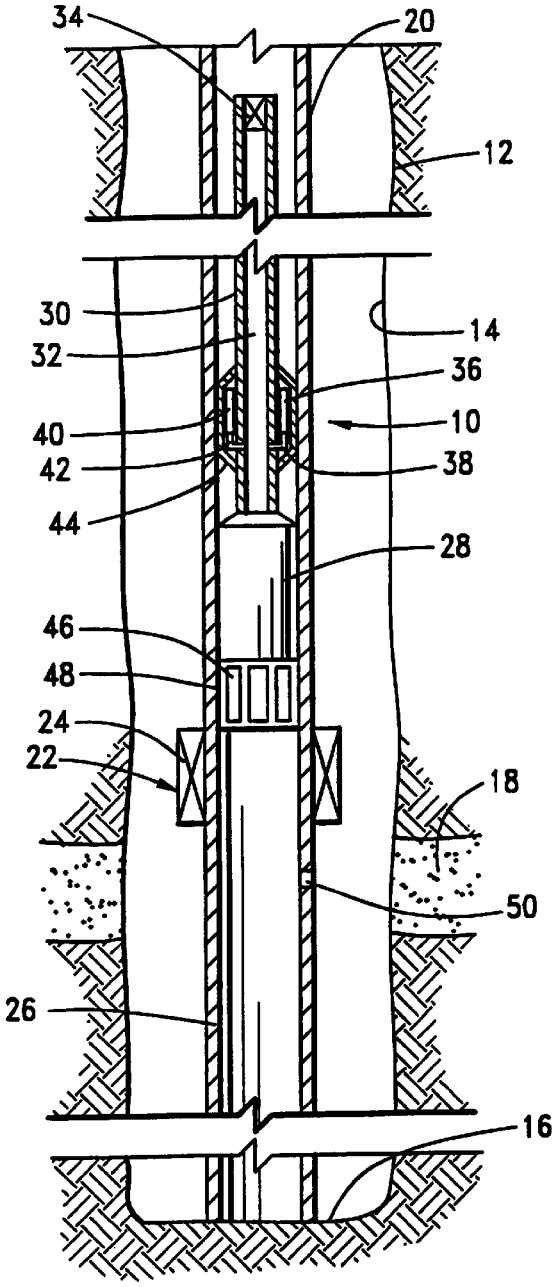
FIG. 1 illustrates the bottom-hole testing apparatus of the present invention as it is run into an open-hole well.

Referring now to the drawings, the apparatus for bottom-hole testing in open-hole wells of the present invention is shown and generally designated by the numeral 10. In FIG. 1, apparatus 10 is shown as it is run into a well 12. Apparatus 10 is designed for use relatively near a bottom 14 of an uncased borehole 16. In the illustrated embodiment, borehole 16 intersects a subsurface formation or zone of interest 18. As used herein, reference to a "zone of interest" includes a subsurface formation.

Apparatus 10 includes a length of drill pipe 20. Apparatus 10 also includes a compression packer disposed on a lower end of drill pipe 20. Packer 22 comprises a packer element 24 thereon. Packer element 24 is adapted to sealingly engage borehole 14 above formation 18 when weight is set down on drill pipe 20.

Figure 2:
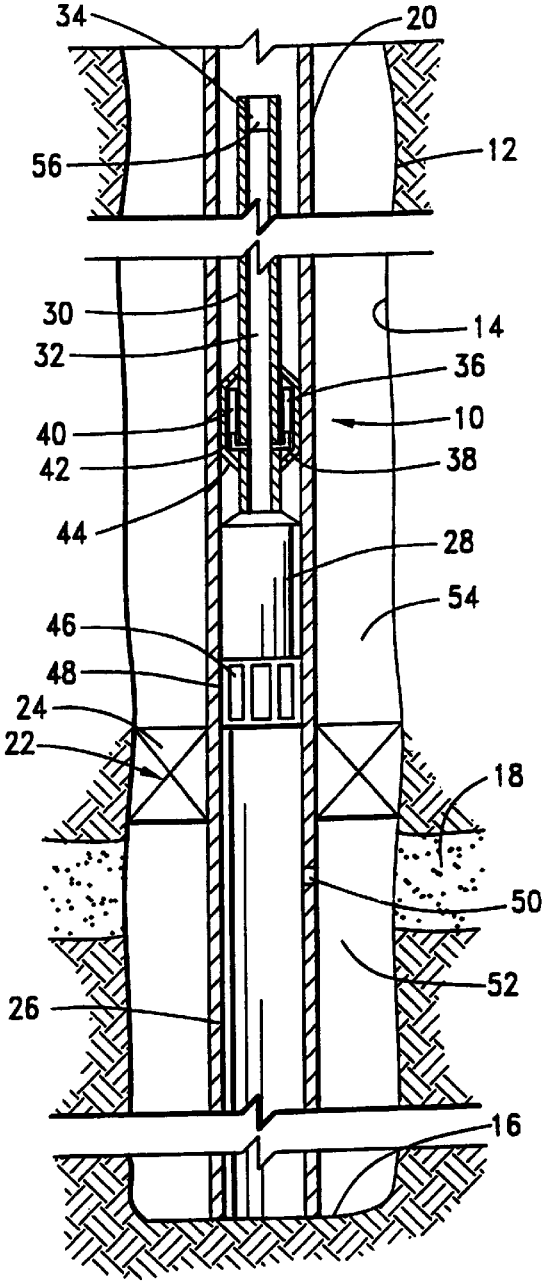
FIG. 2 illustrates the apparatus of FIG. 1 with the packer in a set position and with a housing valve opened.

A lower anchor portion 26 of drill pipe 20 extends downwardly from packer 22 and engages bottom 16 of well 12. This allows the weight to be set down so that packer 22 is compressed and packer element 24 is squeezed radially outwardly into sealing engagement with borehole 14 above zone 18, as seen in FIG. 2.

Packer 22 is preferably a drillable packer so that it can be easily removed in case well formation 18 collapses, as further described herein.

Disposed in drill pipe 20 above packer 22 is a pressure-actuated closure valve 28. Closure valve 28 is preferably a Halliburton Hydrospring tester valve which has a metering section therein to allow the normally closed valve to open after a predetermined time delay after pressure has been applied thereto.

A housing 30 is disposed in drill pipe 20 and is connected to an upper end of closure valve 28. Housing 30 defines a surge chamber 32 therein which will be seen to be in communication with closure valve 28.

At the upper end of surge chamber 32 is a housing valve 34 which is shown in a closed position in FIG. 1 and an open position in FIG. 2. Housing valve 34 is preferably a tubing pressure-actuated valve which can be used to open and close an upper end of surge chamber 32 in a manner described further herein.

A sampler 36, such as a Halliburton Mini-Sampler, is connected to housing 30 by a connector 38 or any other means known in the art. Thus, connector 38 and sampler 36 are in communication with surge chamber 32.

An electronic pressure and/or temperature recording instrument 40, also referred to as a recorder 40, is connected to housing 30 by a another connector 42 or any other means known in the art. Recorder 40 may be similar to the Halliburton HMR. An electronic memory recording fluid resistivity tool, such as manufactured by Sonex or Madden, might be substituted for recorder 40 or used therewith.

An outer cover 44 may be positioned around housing 30, and connected thereto or forming a portion thereof, as desired to protect sampler 36 and recorder 40.

Another recording instrument, such as an electronic gauge 46 in a gauge carrier 48, is positioned below closure valve 28 to measure the conditions of well fluid as it enters apparatus 10.

Closure valve 28, gauge carrier 48 and housing 30, are detachable from drill pipe 20 in the event that the drill pipe gets stuck in the well, as might occur if formation 18 and adjacent portions of the well collapse around packer 22.

OPERATION OF THE INVENTION

As previously mentioned, apparatus 10 is run into well 12 as generally seen in FIG. 1. Drill pipe 20 is lowered until lower anchor portion 26 contacts bottom 16 of well 12. By setting down weight, compression packer 22 is set by squeezing packer element 24 until it is in sealing engagement with wellbore 14 as shown in FIG. 2. Packer 22 itself is of a general kind known in the art.

Thus, a sampling port 50 in anchor portion 26 below packer element 24 is in communication with zone 18 and a lower well annulus portion 52 below packer 22, and the sampling port is isolated from well annulus portion 54 above packer element 22. Of course, wellbore 14 is terminated by bottom 16 below sampling port 50 and formation 18.

Pressure-actuated closure valve 28 is actuated to the open position thereof so that surge chamber 32 is placed in communication with sampling port 50. The opening of closure valve 28 actually takes place after a predetermined time delay resulting from fluid flowing through a metering section of the closure valve. The operation of closure valve 28 is in a manner generally known in the art.

Surge chamber 26 is initially empty, and the opening of closure valve 28 allows the surge chamber to quickly fill because of the formation pressure. First, "dirty" fluid will flow through sampling port 50 and into surge chamber 32, and after a period of time, clean fluid will flow.

After clean fluid enters surge chamber 32, sampler 36 is activated, and a sample of fluid is taken from surge chamber 32 and captured in the sampler. Actual operation of sampler 36 is in a manner known in the art.

Recorder 40 may also be activated to take the appropriate pressure/temperature measurements as desired and send them to the surface. The actual operation of recorder 40 is also known in the art.

Electronic gauge 46 is utilized to provide information on the condition of the well fluid as it enters apparatus 10.

After a fluid sample has been captured in sampler 36, pressure-actuated housing valve 34 may be actuated from the closed position thereof shown in FIG. 1 to the open position shown in FIG. 2 such that an open valve port 56 is defined through housing valve 34. Fluid may then be pumped down drill pipe 20 through open valve port 56, surge chamber 32, closure valve 28 and sampling port 50 to force formation fluid back into formation or zone of interest 18. This operation is known as "bull-heading."

After completion of the test, apparatus 10 is retrieved to the surface. If well formation 18 collapses, packer 22, and thus drill pipe 20, may become stuck in well 12. If this occurs, and the operator is unable to get the apparatus unstuck, closure valve 28, gauge carrier 48 and housing 30, and thus samplers 36 and recorders 40, are disconnected from drill pipe 20 and retrieved to the surface. Packer 22 may be drillable so that it can be removed from well 12 by drilling, and thus, no longer be an impediment to further operations.

Once apparatus 10 is at the surface, sampler 36 is removed. Sampler 36 may be drained on location, its contents may be transferred to a sample bottle for shipment to a pressure-volume-test (PVT) laboratory, or the entire sampler 36 may be shipped to a PVT laboratory for fluid transfer and testing.

Memory gauges and recorders 40 may be read, and the pressure, temperature and resistivity data analyzed to determine formation or zone pressure and temperature, permeability, and sample fluid resistivity.

By controlling the actuation of closure valve 28, it will be seen that clean fluid flow to sampler 36 is provided. With the exception of weight-set packer 22, all of the operation of apparatus 10 and control thereof is accomplished by pressure actuation.

It will be seen, therefore, that the apparatus and method of testing a well in the present invention are well adapted to carry out the ends and advantages mentioned as well as those inherent therein. While a presently preferred embodiment has been shown for the purposes of this disclosure, numerous changes in the arrangement and construction of parts in the apparatus and in steps in the method of testing may be made by those skilled in the art. All such changes are encompassed within the scope and spirit of the appended claims.

What is claimed is:

1. A method of testing a well, comprising the steps of:

(a) running a tool into the well, the tool comprising:
- a housing defining a surge chamber therein;
- a normally closed closure valve in communication with the surge chamber;
- a packer connected to the housing and having a packer element engagable with an inner surface of the well; and
- a sampler in communication with the housing;

(b) setting the packer into sealing engagement with the inner surface of the well adjacent to a zone of interest in the well;

(c) applying pressure in the tool for actuating the closure valve to place the surge chamber in communication with a well portion below the packer;

(d) initiating fluid flow from the zone through the closure valve into the surge chamber; and (e) after flowing some fluid, capturing a sample of fluid in the sampler.

2. The method of claim 1 wherein step (d) comprises flowing dirty fluid from the zone for a sufficient time so that substantially cleaner fluid is flowed into the surge chamber prior to step (e).

3. The method of claim 1 wherein the packer is a compression packer.

4. The method of claim 3 wherein step (b) comprises setting down weight on the tool to place the packer element into sealing engagement with the inner surface of the well.

5. The method of claim 1 further comprising:

(f) closing the closure valve to close the surge chamber.

6. The method of claim 5 further comprising:

(g) releasing the housing, housing valve, closure valve and sampler from the packer; and (h) removing the housing, housing valve, closure valve and sampler from the well.

7. The method of claim 6 further comprising:

(i) drilling the packer out of the well.

8. The method of claim 1 wherein:

in step (a), the tool further comprises a normally closed housing valve in communication with the surge chamber; and further comprising the steps of:

(f) applying pressure in the tool for actuating the housing valve to an open position; and (g) applying pressure to the tool through the open housing valve, the surge chamber and the closure valve to force formation fluid back into the zone of interest.

9. An apparatus for use in testing an uncased well and obtaining a fluid sample from a subsurface zone of interest in the well, the apparatus comprising:

a drill pipe defining an opening therein;

a compression packer disposed on the drill pipe above the opening and adapted for sealing engaging an inner surface of the well adjacent to the zone;

a housing disposed in the drill pipe, the housing defining a surge chamber therein;

a closure valve disposed in the drill pipe and in communication with an end of the surge chamber; and a sampler disposed in the drill pipe and in communication with the surge chamber.

10. The apparatus of claim 9 wherein the closure valve is a pressure-actuated valve.

11. The apparatus of claim 9 wherein the closure valve is a normally closed valve which may be actuated to place the surge chamber in communication with the opening in the drill pipe and thereby allow fluid flow from the zone into the surge chamber such that a fluid sample may be captured in the sampler.

12. The apparatus of claim 9 wherein the housing, closure valve and sampler are detachable from the drill pipe.

13. The apparatus of claim 12 wherein the packer is a drillable packer.

14. The apparatus of claim 9 further comprising a housing valve disposed in the drill pipe in communication with an opposite end of the surge chamber from the closure valve, the housing valve being normally closed.

15. The apparatus of claim 14 wherein the housing valve is a pressure-actuated valve.

16. The apparatus of claim 9 wherein the sampler may be opened to take a fluid sample after a predetermined time delay.

17. The apparatus of claim 16 wherein the sampler is a pressure-actuated sampler.

18. A method of testing a previously non-produced segment of an uncased wellbore, comprising the steps of:

(a) running a tool into the uncased wellbore, the tool comprising:
- a housing defining a surge chamber therein; and
- a packer connected to the housing and adapted for sealingly engaging an inner surface of the uncased wellbore;

(b) setting the packer into sealing engagement with the inner surface of the uncased wellbore adjacent to the previously non-produced segment;

(c) placing the surge chamber in communication with the previously non-produced segment;

(d) flowing fluid from the previously non-produced segment into the surge chamber; and (e) capturing a sample of fluid from the previously non-produced segment.

19. The method of claim 18 wherein step (e) occurs a predetermined period of time after step (d).

20. The method of claim 18 wherein step (d) comprises flowing dirty fluid from the previously non-produced segment for a sufficient time so that substantially cleaner fluid is flowed into the surge chamber prior to step (e).

21. The method of claim 18 wherein the packer is a compression packer.

22. The method of claim 21 wherein step (b) comprises setting down weight on the tool to place the packer into sealing engagement with the inner surface of the uncased wellbore.

23. The method of claim 18 further comprising:

(f) after step (e), closing the surge chamber.

24. The method of claim 18 further comprising the step of:

(f) applying pressure to the tool to force formation fluid back into said previously non-produced segment.

25. A method of testing a well, comprising the steps of:

(a) running a tool into the well, the tool comprising:

a packer adapted for sealingly engaging an inner surface of the well; and a sampler in communication with the housing;

(b) setting the packer such that the packer is sealingly engaged with the inner surface of the well and adjacent to a zone of interest in the well;

(c) initiating fluid flow from the zone;

(d) capturing a sample of fluid in the sampler; and (e) applying pressure through the tool to force formation fluid back into the zone of interest.

26. The method of claim 25 wherein:

the tool further comprises:

a housing defining a surge chamber therein; and a normally closed closure valve in communication with the surge chamber;

step (c) comprises actuating the closure valve to an open position, thereby placing the surge chamber in communication with a well portion below the packer and initiating the fluid flow from the zone through the closure valve and the surge chamber.

27. The method of claim 26 wherein:

the tool further comprises a normally closed housing valve in communication with the surge chamber; and further comprising, prior to step (e), the step of actuating the housing valve to an open position.

28. The method of claim 27 wherein step (e) comprises applying pressure through the open housing valve, the surge chamber and the closure valve.

29. The method of claim 27 wherein the step of actuating the housing valve to the open position comprises applying pressure in the tool.

30. The method of claim 26 wherein step (c) comprises flowing dirty fluid from the zone for a sufficient time so that substantially cleaner fluid is flowed into the surge chamber prior to step (d).

31. The method of claim 26 wherein step (c) comprises applying pressure in the tool for actuating the closure valve to the open position.

* * * * *